US005323599A

United States Patent [19]

Wassenhoven

[11] Patent Number: 5,323,599

[45] **Date of Patent: * Jun. 28, 1994**

[54] PROCESS AND APPARATUS FOR PRODUCING HAIRINESS IN AN OPEN-END SPINNING YARN

[75] Inventor: Heinz-Georg Wassenhoven, Moenchengladbach, Fed. Rep. of Germany

[73] Assignee: W. Schlafhorst & Co., Moenchengladbach, Fed. Rep. of Germany

[ * ] Notice: The portion of the term of this patent subsequent to Mar. 23, 2010 has been disclaimed.

[21] Appl. No.: 925,309

[22] Filed: Aug. 4, 1992

Related U.S. Application Data

[63] Continuation of Ser. No. 639,314, Jan. 8, 1991, abandoned, which is a continuation of Ser. No. 335,058, Apr. 7, 1989, abandoned.

[30] Foreign Application Priority Data

Apr. 8, 1988 [DE] Fed. Rep. of Germany ..... 3811739

[51] Int. Cl.[5] ..... D01H 4/08

[52] U.S. Cl. ..... 57/417; 57/333

[58] Field of Search ..... 57/417, 415, 411, 403, 57/333, 341, 314

[56] References Cited

U.S. PATENT DOCUMENTS

| | | | |
|---|---|---|---|
| 4,458,477 | 7/1984 | Raasch et al. | 57/417 X |
| 4,499,719 | 2/1985 | Faessler | 57/417 |
| 4,642,981 | 2/1987 | Shimano | 57/417 X |
| 4,665,687 | 5/1987 | Ott et al. | 57/417 |
| 4,773,211 | 9/1988 | Stahlecker et al. | 57/417 |
| 4,796,421 | 1/1989 | Stahlecker et al. | 57/417 |
| 4,829,762 | 5/1989 | Wassenhoven | 57/417 |
| 4,843,812 | 7/1989 | Raasch | 57/417 |
| 4,854,119 | 8/1989 | Stahlecker et al. | 57/417 |

*Primary Examiner*—Joseph J. Hail, III

*Attorney, Agent, or Firm*—Shefte, Pinckney & Sawyer

[57] ABSTRACT

A process and apparatus for treating yarn formed on an open-end spinning machine of the type wherein the yarn is drawn from a rotor through a navel and through draw-off rolls is provided. The yarn is guided from the navel to the draw-off rolls in a path at least a portion of which is inclined with respect to the axis of the navel and a false twist is applied to the yarn during its travel in the inclined portion of the path between the navel and the draw-off rolls. The yarn is permitted to untwist between the false twist application and the draw-off rolls in response to the applied false twist. The untwisting of the yarn causes fiber ends on the surface of the yarn to project outwardly in a hairiness or fleeciness producing manner. The false twist applying element can include a member which produces a rotating air stream about the periphery of the traveling yarn. An initial false twist applying element or elements may be located obliquely at the change of direction location to impart an initial false twist to the yarn.

9 Claims, 1 Drawing Sheet

PROCESS AND APPARATUS FOR PRODUCING HAIRINESS IN AN OPEN-END SPINNING YARN

This is a continuation of co-pending application Ser. No. 639,314, filed Jan. 8, 1991, now abandoned, which is a continuation of co-pending application Ser. No. 335,058, filed Apr. 7, 1989, now abandoned.

BACKGROUND OF THE INVENTION

The present invention relates to a process and apparatus for treating yarn formed in an open-end spinning machine of the type wherein the yarn is drawn from a rotor through a navel and through draw-off rolls.

In the production of yarn in an open-end spinning process, it is known that the yarn is characterized by a relatively hard feel. It would be desirable to have the capability to produce yarn by an open-end spinning process which is characterized by hairiness or fleeciness so as to have a relatively soft feel. Such a yarn would particularly enhance goods such as knitwear or knitted goods produced from such yarn.

SUMMARY OF THE INVENTION

The present invention provides a process and apparatus for treating yarn formed in an open-end spinning process such that the yarn is characterized by hairiness or fleeciness.

The present invention provides a process and apparatus for treating yarn in an open-end spinning process such that the yarn withdrawal rate can be relatively high even in the case of yarn having a relatively small degree of twist, thus enhancing the efficiency and productivity of the open-end spinning process.

Briefly described, the present invention provides a process for treating yarn formed on an open-end spinning machine of the type wherein the yarn is drawn from a rotor through a navel and through draw-off rolls. The process includes guiding the yarn from the navel to the draw-off rolls in a path at least a portion of which is inclined with respect to the axis of the navel, applying a false twist to the yarn in the inclined portion of the path between the navel and the draw-off rolls and permitting the yarn to untwist between the false twist application and the draw-off rolls in response to the applied false twist whereby the untwisting causes fiber ends on the surface of the yarn to project outwardly in a hairiness producing manner. Preferably, applying the false twist to the yarn includes applying a pressurized fluid transversely to the direction of travel of the yarn. Preferably, the pressurized fluid is applied to provide a false twist in the direction of the real twist of the yarn.

In the preferred embodiment, guiding the yarn includes guiding the yarn in advance of the false twist application into contact with an initial false twist producing element to produce an initial false twist in the yarn prior to the false twist application. Preferably, guiding the yarn into contact with the initial false twist producing element includes guiding the yarn into contact with an initial false twist producing element oriented obliquely to the path to guide the yarn at an incline with respect to the axis of the navel.

The present invention also provides an apparatus for treating yarn formed in an open-end spinning machine of the type wherein the yarn is drawn from a rotor through a navel and through draw-off rolls. The apparatus includes means for changing the direction of travel of the yarn, the direction changing means changing the direction of travel of the yarn at a location between the navel and the draw-off rolls from a direction along the axis of the navel to a direction inclined with respect to the axis of the navel, and means for applying the false twist to the yarn. The false twist applying means is intermediate the change of direction and is spaced from the draw-off rolls sufficient to permit the yarn to untwist in advance of the draw-off rolls in response to the false twist applied by the false twist applying means, whereby the untwisting of the yarn causes fiber ends on the surface of the yarn to project outwardly in a hairiness producing manner.

In the preferred embodiment, the direction changing means includes an initial false twist producing element for producing an initial false twist in the yarn in advance of the false twist applied to the yarn by the false twist applying means.

DETAILED DESCRIPTION OF THE PREFERRED EMBODIMENTS

Figures 1, 2, 3, 4:
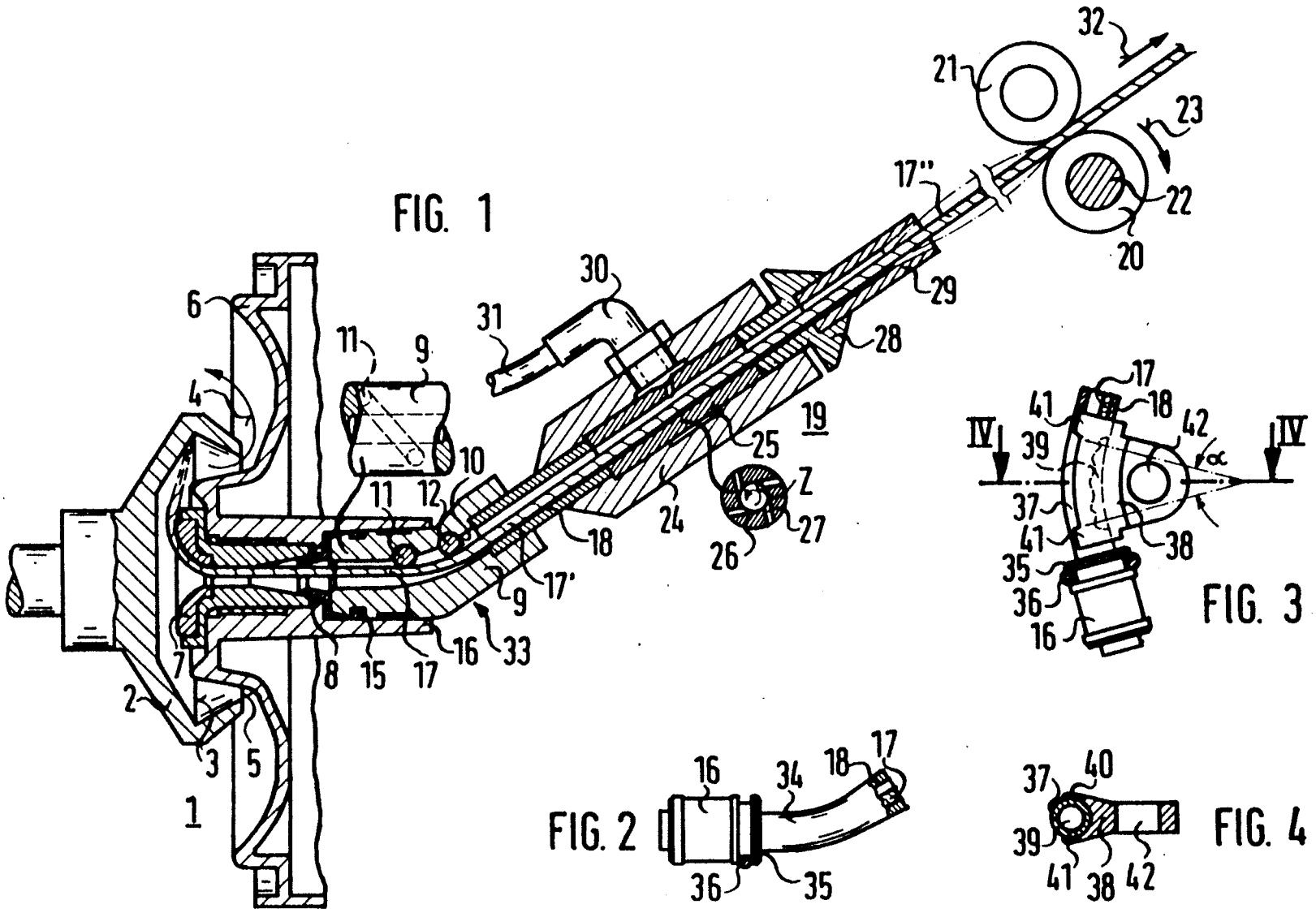
FIG. 1 is a vertical sectional view of the yarn treatment apparatus of the present invention, showing the yarn treatment apparatus installed in its operating location between the navel of an open-end spinning machine and the draw-off rolls of the spinning machine.
FIG. 2 is a partial top plan view of another embodiment of the yarn treatment apparatus of the present invention.
FIG. 3 is a partial top plan view of an alternative embodiment of the yarn treatment apparatus of the present invention.
FIG. 4 is a vertical sectional view of the yarn treatment apparatus shown in FIG. 3, taken along line IV—IV in FIG. 3.

In FIG. 1, one preferred embodiment of the yarn treatment apparatus of the present invention is illustrated. A rotor 2 of an open-end spinning machine 1 (not further shown or described) is illustrated in vertical section and includes an annular fiber collection groove 3 which operates in conventional manner for collection of fibers while air is continuously drawn, in the direction shown by the arrow 4, outwardly from the interior of the rotor 2 past its outer peripheral edge 5 and through a passageway defined between the rotor 2 and a rotor cover 6.

A navel 7 having a central axial passageway is centrally mounted in the rotor cover 6 and a change of direction means 33 is also mounted to the rotor cover 6 and communicated with the navel 7. A yarn 17 is continuously formed from fibers which collect in the annular fiber collection groove 3 and is continuously drawn out of the rotor 2 through the central axial passageway in the navel 7 by a pair of draw-off rolls 20,21. The draw-off roll 21 is drivingly mounted to a shaft 22 of a motor (not shown) for rotation in the direction indicated by the arrow 23. The yarn 17 is drawn in the direction indicated by the arrow 32 under the cooperating action of the draw-off rolls 20,21.

The direction changing means 33 includes a non-linear conduit member 9, one end of which is press-fitted into a cylindrical bore formed in a projecting portion 16 of the rotor cover 6 which projects from the rotor cover 6 in a direction opposite to the navel 7. A sealing ring 15 seated in an annular groove on the outer surface adjacent the inserted end of the conduit 9 seals the inserted end of the conduit 9 with respect to the cylindrical bore of the projecting portion 16. An interconnecting member 8 is mounted between the navel 7 and the conduit 9 and includes a central axial passageway for passage therethrough of a yarn 17 which is continuously drawn outwardly of the spinning rotor 3 through the central axial opening of the navel 7. The yarn 17 is formed from staple-length fibers which collect in the annular collection groove 3.

The conduit 9 has a curved passageway extending therethrough, one end of which is communicated with the interconnecting member 8 and the other end of which is open at the other end of the conduit 9. The conduit 9 includes an initial false twist producing element having a pair of cylindrical pegs 11,12 which are inserted through bores extending from the outer surface of the conduit to its curved passageway. The cylindrical pegs 11,12 are located with their lengths oblique to the direction of travel of the yarn 17 through the curved passageway of the conduit 9. Additionally, the cylindrical pegs 11,12 are located at the location within the curved passageway at which the direction of travel of the yarn 17 changes as the yarn travels therethrough. Specifically, the cylindrical pegs 11,12 are located at a portion 10 of the curvature of the curved passageway which has the smallest radius of curvature.

As best shown in the enlarged cutaway view of the conduit 9 in FIG. 1, the cylindrical pegs 11,12 are oriented relative to the direction of travel of the yarn 17 through the conduit 9 such that the yarn is guided at an incline with respect to the axis of the navel 7.

The conduit 9 is mounted to the rotor cover 6 such that the curved passageway curves at an incline with respect to the axis of the navel 7. At the end of the conduit 9 opposite the end adjacent the interconnecting member 8, a means for guiding the yarn between the change of direction location of the conduit 9 and the draw-off rolls 20,21 is mounted by press-fitting or other appropriate means to the conduit 9. The guiding means includes a tube 18, a means 19 for applying a false twist to the yarn 17 and a muzzle member 28. The false twist applying means 19 includes a housing 24 having an axial cylindrical bore and a chamber 25 centrally located in the axial cylindrical bore and of greater radial extent, an insert 26 centrally mounted within the bore of the housing 24 and having an axial cylindrical bore, a pressurized fluid conduit connecting elbow 30 and a pressurized fluid conduit 31. One axial end of the connecting elbow 30 is threaded for interconnecting the elbow to a compatibly threaded, radially extending bore extending from the outer surface of the housing 24 to the chamber 25. The pressurized fluid conduit 31 is connected to, and communicated with, the other end of the connecting elbow 30 and the pressurized fluid conduit 31 is connected at its other end to a means for supplying pressurized fluid (not shown). One end portion of the tube 18 is mounted in, and coaxial with, the cylindrical bore of the housing 24 and the other end portion of the tube 18 is fixedly mounted by press-fitting or other appropriate securement means to the conduit 9. The end portion of the tube 18 in the cylindrical bore of the housing 24 abuts one axial end of the insert 26.

The muzzle member 28 includes an axial cylindrical bore and the muzzle member is fixedly mounted by adhesive or other appropriate securement means to the housing 24 such that its axial cylindrical bore is communicated with the axial cylindrical bore of the insert 25 and such that the muzzle member 28 abuts the insert 26. The end of the muzzle member 28 opposite its end mounted to the housing 24 includes a conical mouth portion 29 communicated with the axial cylindrical bore of the muzzle member and opening outwardly in the direction of the arrow 32. Accordingly, the cylindrical bores of the muzzle member 28, the insert 26 and the tube 18 and the curved passageway of the conduit 9 are all communicated together to form a path for guiding the yarn 17 between the navel 7 and the draw-off rolls 20,21.

The insert 26 includes four cylindrical bores 27 extending from its outer circumference to its central axial bore. Each cylindrical bore 27 is located such that it is inclined slightly in a direction opposite to the direction of travel of the yarn 17 through the insert 26. The chamber 26 communicates the cylindrical bores 27 with the connecting elbow 30. Accordingly, when pressurized fluid, such as, for example, compressed air, is supplied by the pressurized fluid supply means through the pressurized fluid conduit 31, the connecting elbow 30 and the chamber 26 to the cylindrical bores 27, the cylindrical bores 27 direct the pressurized fluid into the axial cylindrical bore of the insert 26 in a tangential manner to create a rotating air stream Z which rotates about the circumference of the axial cylindrical bore of the insert 26 in a direction of rotation to create a false twist in the same direction as the real twist of the yarn 17.

The tube 18, the insert 26 and the muzzle member 28 define a portion of the path of travel of the yarn 17 which is inclined with respect to the axis of the navel 17. Additionally, the inclination of the path portion formed by the tube 18, the insert 26 and the muzzle member 28 is different than the inclination of the portion of the path of travel of the yarn 17 defined by the cylindrical pegs 11,12 of the initial false twist producing element. Specifically, due to the oblique orientation of the cylindrical pegs 11,12 with respect to the curved passageway of the conduit 9, the path of travel of the yarn between the pair of cylindrical pegs 11,12 is inclined laterally with respect to the direction of travel of the yarn 17 in the inclined path portion defined by the tube 18, the insert 26 and the muzzle member 28.

In operation, staple-length fibers are fed into the spinning chamber of the spinning rotor 2 and the fibers slide into the annular collection groove 3. The collected fibers are continuously drawn outwardly of the spinning rotor 2 through the central axial passageway in the navel 7 by the draw-off rollers 20,21. As the yarn 17 is drawn through the curved passageway of the conduit 9, the yarn contacts the cylindrical pegs 11,12 of the initial false twist producing element and an initial false twist, in the direction of the real twist of the yarn 17, is produced in advance of the travel of the yarn 17 through the yarn guiding means 19. As the yarn passes between the cylindrical pegs 11,12, the direction of travel of the yarn is changed from a direction of travel along the axis of the navel 7 to a direction of travel inclined with respect to the axis of the navel 7. Thus, the portion of the yarn 17 which has just traveled past the cylindrical peg 12, designated as 17', travels in a direction inclined obliquely with respect to the axis of the navel 7. Thereafter, the yarn 17 travels through the tube 18 and into the insert 26 wherein the rotating air stream Z acts on the yarn to produce a false twist in the direction of the real twist of the yarn.

Following the application of the false twist by the false twist applying means 19, the yarn travels through the muzzle member 28 and, as the yarn emerges from the conical mouth portion 29 thereof, the emerging yarn, designated as 17", begins to balloon, that is, the yarn orbits generally about its axis. The draw-off rollers 20,21 are positioned with respect to the yarn guiding means 19 and, specifically, with respect to the end portion of the muzzle member 28 which includes the conical portion 29, such that the ballooning yarn 17" can move in a ballooning manner sufficient to untwist the false twist applied thereto by the false twist applying means 19. The untwisting of the yarn 17 causes fiber ends on the surface of the yarn to project outwardly in a hairiness or fleeciness producing manner. Specifically, the centrifugal and other forces caused by the untwisting move the fiber ends on the surface of the yarn radially outwardly. Accordingly, at least by the time the yarn 17 travels between the draw-off rolls 20,21, the false twist applied thereto by the false twist applying means 19 has been substantially completely released and fiber ends on the surface of the yarn project outwardly to give the yarn a hairy or fleecy characteristic.

In FIG. 2, another embodiment of the change of direction means 33 of the yarn treatment apparatus of the present invention is illustrated. A non-linear pipe 34 has one end thereof mounted in the cylindrical bore of the projecting portion 16 of the rotor cover 6. A coupling sleeve 35 is fitted within the projecting portion 16 and on the pipe 34 to interconnect the portion 16 and the pipe 34. The coupling sleeve 35 has an annular seat which seats an annular sealing ring 36 to seal the end of the pipe 34 mounted within the projection 16 with respect to the projection. The direction of travel of the yarn 17 changes from a direction along the axis of the navel 7 to a direction inclined with respect to the axis of the navel 7 as the yarn travels through the pipe 34.

In FIGS. 3 and 4, another embodiment of the direction changing means of the yarn treatment apparatus of the present invention is illustrated. A non-linear pipe 37 is mounted to, and communicated with, the projecting portion 16 of the rotor cover 6 by a coupling sleeve 35. The coupling sleeve 35 includes an annular seat which seats a sealing ring 36 to seal the end of the pipe 37 with respect to the projecting portion 16. The other end of the pipe 37 is connected by conventional means to the tube 18. The pipe 37 includes a slot extending along an axial portion thereof through an angle alpha, as measured along the radius of curvature of the pipe. A curved ceramic insert 39 having a plurality of ribs formed thereon, is compatibly constructed to be received within the slot of the pipe 37. The side of the ceramic insert 39 opposite its ribbed side is connected by adhesive or other appropriate securement means to a plastic clip member 38. The clip member 38 includes a mounting bore 42 and has a first pair of projections 40 and a second pair of projections 41. The projections 40,41 cooperate with one another to compressively engage the pipe 37 therebetween to secure the clip member 38 to the pipe 37 so as to maintain the ceramic insert 39 in its inserted position in the pipe 37. As the yarn 17 travels through the pipe 37, the ribs of the ceramic insert 39 contact the yarn and act as twist stopping elements to stop further movement of the false twist applied by the false twist applying means 19 along the yarn in the direction of the navel 7.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A process for treating yarn formed on an open-end spinning machine, the open-end spinning machine having a rotor with an annular fiber collecting groove having an axis, a navel defining an exit opening from the rotor and having an axis parallel to the axis of the annular fiber collecting groove, and draw-off rolls, the rotor being operable to entrain fibers collected in the annular fiber collecting groove in a yarn which is withdrawn from the rotor through the navel along the axis of the navel, comprising:

changing the direction of travel of the yarn from its direction of travel along the axis of the navel to a direction of travel inclined with respect to the axis of the navel;

guiding the yarn substantially uni-directionally along said inclined direction during travel of the yarn between the navel and the draw-off rolls;

imposing a cyclonic air flow on the yarn for applying a false twist to the yarn during travel of the yarn along said inclined direction as the yarn travels along said inclined direction between the navel and the draw-off rolls; and inducing the yarn to balloon and sufficiently untwist between the false twist application and the draw-off rolls to cause fiber ends on the surface of the yarn to project outwardly in a hairiness producing manner.

2. A process according to claim 1 and characterized further in that said inducing the yarn to untwist includes inducing untwisting of the yarn in such manner that centrifugal forces move the fiber ends on the surface of the yarn radially outwardly in a hairiness producing manner.

3. A process according to claim 1 and characterized further in that said imposing a cyclonic air flow includes applying a pressurized fluid obliquely to the direction of travel of the yarn.

4. A process according to claim 3 and characterized further in that applying said pressurized fluid includes applying said pressurized fluid to provide a false twist in the direction of the real twist of the yarn.

5. A process according to claim 1 and characterized further in that said guiding includes guiding the yarn in advance of said false twist application into contact with an initial false twist producing element to produce an initial false twist in the yarn prior to said false twist application.

6. A process according to claim 5 and characterized further in that said guiding the yarn into contact with said initial false twist producing element includes guiding the yarn into contact with an initial false twist producing element oriented obliquely to said path to guide the yarn at an incline with respect to the axis of the navel.

7. A process according to claim 1 and characterized further in that said guiding includes guiding the yarn in a portion of said path extending axially from the navel and thereafter guiding the yarn in said inclined portion.

8. A process according to claim 7 and characterized further in that said axially extending path portion and said inclined path portion are communicated with one another at a juncture and an initial false twist producing element is located at said juncture, said guiding including guiding the yarn in said axially extending path portion, guiding the yarn into contact with said initial false twist producing element in advance of said false twist applying and thereafter guiding the yarn in said inclined path portion.

9. An apparatus for treating yarn formed in an open-end spinning machine, the open-end spinning machine including a rotor with an annular fiber collecting groove having an axis, a navel defining an exit opening from the rotor and having an axis parallel to the axis of the annular fiber collecting groove, and draw-off rolls, the rotor being operable to continuously entrain fibers collected in the annular fiber collecting groove in a yarn which is withdrawn from the rotor through the navel in a direction of travel along the axis of the navel, the apparatus comprising:

means forming a curved passageway for passage therethrough of the yarn, the curved passageway having an entrance aligned with the axis of the navel for passage of the yarn into the curved passageway as the yarn is withdrawn along the axis of the navel and at least one elongate projection extending along the curved passageway obliquely to the direction of travel of the yarn for changing the direction of travel of the yarn from the direction along the axis of the navel to a direction inclined with respect to the axis of the navel and for preventing the propagation therepast of twist imparted to the yarn by the rotor;

means for guiding the yarn to travel substantially uni-directionally in said inclined direction during travel of the yarn from said curved passageway to the draw-off rolls; and means for applying a false twist in the direction of the real twist to the yarn as the yarn is guided in said inclined direction, said false twist applying means including means for imposing a cyclonic air flow on the yarn, said false twist applying means being spaced from the draw-off rolls sufficiently to induce ballooning movement of the yarn and cause the yarn to sufficiently untwist between the means for applying a false twist and the draw-off rolls during the travel of the yarn substantially uni-directionally in said inclined direction to cause fiber ends on the surface of the yarn to project outwardly in a hairiness producing manner.

* * * * *